US007625231B2

(12) United States Patent
Takahira

(10) Patent No.: US 7,625,231 B2
(45) Date of Patent: Dec. 1, 2009

(54) ADAPTOR FOR CABLE CONNECTOR

(75) Inventor: Hiroshi Takahira, Kawasaki (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 12/147,233

(22) Filed: Jun. 26, 2008

(65) Prior Publication Data

US 2009/0004910 A1 Jan. 1, 2009

(30) Foreign Application Priority Data

Jun. 29, 2007 (JP) ..... 2007-172680
Apr. 24, 2008 (JP) ..... 2008-114429

(51) Int. Cl.
*H01R 12/24* (2006.01)

(52) U.S. Cl. ..... 439/495; 439/260

(58) Field of Classification Search ..... 439/67, 439/77, 260, 492, 493, 494, 495
See application file for complete search history.

(56) References Cited

U.S. PATENT DOCUMENTS 4,189,200 A 2/1980 Yeager et al.
4,630,874 A 12/1986 Renn et al.
5,458,506 A 10/1995 Yamaguchi et al.
5,709,573 A 1/1998 McClure
5,953,815 A 9/1999 Kaminski et al.
5,954,521 A 9/1999 Yang
6,039,600 A 3/2000 Etters et al.
6,056,571 A 5/2000 Noro
6,099,346 A 8/2000 Hashiguchi et al.
6,123,558 A 9/2000 Shibata
6,126,472 A 10/2000 Choy
6,162,083 A 12/2000 Seto
6,176,737 B1 1/2001 Choy (Continued)

FOREIGN PATENT DOCUMENTS

CN 1549400 A 11/2004

(Continued)

OTHER PUBLICATIONS

Chinese Office Action for Chinese Patent Application No. 2004100807089, dated Mar. 10, 2006.

(Continued)

*Primary Examiner*—Thanh-Tam T Le
(74) *Attorney, Agent, or Firm*—Finnegan, Henderson, Farabow, Garrett & Dunner, LLP

(57) ABSTRACT

An adapter for a cable connector secured with a cable end portion to make the electrical connection by being removably mounted on a receptacle of the cable connector includes a pair of operation portions, a pair of guide pins integrally formed in front of the operation portions and each having a pointed end portion at the front, a protection portion for connecting the operation portions at the rear lower part, a connection portion for connecting the operation portions at the front upper part, and a reinforcing portion for connecting the pair of guide pins, wherein the protection portion and the connection portion have an interval in the longitudinal and vertical directions and are disposed in parallel to each other, and the lower surfaces of the connection portion and the reinforcing portion are continuous flush to form a stationary surface for securing the cable end portion.

4 Claims, 11 Drawing Sheets

U.S. PATENT DOCUMENTS

| | | | | |
|---|---|---|---|---|
| 6,203,345 | B1 | 3/2001 | Roque et al. | |
| 6,210,174 | B1 | 4/2001 | Pei et al. | |
| 6,210,209 | B1 | 4/2001 | Wu et al. | |
| 6,261,106 | B1 | 7/2001 | Tung | |
| 6,383,017 | B1 | 5/2002 | Takayasu | |
| 6,419,524 | B1 | 7/2002 | Ma | |
| 6,431,897 | B1 | 8/2002 | Hashiguchi et al. | |
| 6,482,027 | B2 | 11/2002 | Ishii et al. | |
| 6,506,074 | B2 | 1/2003 | Hashimoto | |
| 6,676,444 | B2 | 1/2004 | Noro | |
| 6,755,682 | B2 | 6/2004 | Kunishi et al. | |
| 6,767,233 | B2 | 7/2004 | Tsunematsu | |
| 6,790,074 | B1 | 9/2004 | Chiu | |
| 6,808,412 | B2 | 10/2004 | Ishii | |
| 6,851,968 | B2 | 2/2005 | Tsunematsu | |
| 6,855,009 | B2 | 2/2005 | Nishiyama | |
| 6,863,559 | B2 | 3/2005 | Yu | |
| 6,869,307 | B2 | 3/2005 | Endo | |
| 6,921,274 | B2 | 7/2005 | Yu | |
| 7,048,573 | B2 | 5/2006 | Masaki et al. | |
| 7,101,188 | B1 | 9/2006 | Summers et al. | |
| 7,140,909 | B2 * | 11/2006 | Moritake | 439/492 |
| 7,189,105 | B2 * | 3/2007 | Takaku et al. | 439/497 |
| 7,273,381 | B2 | 9/2007 | Ito | |
| 7,297,020 | B2 | 11/2007 | Takahira | |
| 2002/0119704 | A1 | 8/2002 | Ito et al. | |
| 2003/0092310 | A1 | 5/2003 | Kunishi et al. | |
| 2005/0075004 | A1 | 4/2005 | Endou et al. | |
| 2006/0172590 | A1 | 8/2006 | Yamada et al. | |
| 2006/0189175 | A1 | 8/2006 | Kinsley | |
| 2007/0054545 | A1 | 3/2007 | Takahira | |

FOREIGN PATENT DOCUMENTS

| | | | |
|---|---|---|---|
| EP | 0 933 837 | B1 | 8/1999 |
| JP | 59-110990 | U | 7/1984 |
| JP | 63-83779 | U | 6/1988 |
| JP | 07-057825 | | 3/1995 |
| JP | 8-148222 | A | 6/1996 |
| JP | 08-306446 | | 11/1996 |
| JP | 09-293571 | | 11/1997 |
| JP | 11-121108 | | 4/1999 |
| JP | 11-195464 | | 7/1999 |
| JP | 2000-251024 | | 9/2000 |
| JP | 2000-251025 | | 9/2000 |
| JP | 2002-56935 | | 2/2002 |
| JP | 2002-100425 | | 4/2002 |
| JP | 2002-100426 | | 4/2002 |
| JP | 2002-124321 | | 4/2002 |
| JP | 2002-270261 | A | 9/2002 |
| JP | 3380539 | | 12/2002 |
| JP | 03-425696 | | 5/2003 |
| JP | 2003-272774 | | 9/2003 |
| JP | 2005-4993 | | 1/2005 |
| JP | 2005-129490 | | 5/2005 |
| JP | 2006-85989 | | 3/2006 |

OTHER PUBLICATIONS

Chinese Office Action in counterpart Chinese Patent Application No. 200610101733.X, dated Nov. 16, 2007.

Office Action dated Feb. 15, 2008 in corresponding Chinese Patent Application No. 2006-10151635.7.

Official Notice from Japanese Patent Office for corresponding Japanese Patent Application No. 2002-098965.

Official Notice of Rejection of Japanese Patent Office for corresponding Japanese Patent Application No. 2004-239954, dated Oct. 16, 2007.

* cited by examiner

ADAPTOR FOR CABLE CONNECTOR

This application claims the benefit of Japanese Patent Application Nos. 2007-172680, filed Jun. 29, 2007 and 2008-114429, filed Apr. 24, 2008 which are hereby incorporated by reference herein in their entirety.

BACKGROUND OF THE INVENTION

1. Field of the Invention

The present invention relates to an adapter for a cable connector for electrically connecting one end of a flexible and flat cable such as a flexible flat cable or a flexible printed wiring board to the cable connector provided on a wiring board.

2. Description of the Related Art

A cable connector is practically employed in making the electrical connection between electric components inside an electronic apparatus. The cable connector has a connection structure of a cable for electrically connecting an electric component or a printed wiring board (PB) for an electronic apparatus via a flexible cable such as a flexible flat cable (FFC) or a flexible printed circuit board (FPC), for example.

Such cable connection structure as the cable connector comprises a male connector formed at one end of the cable and a female connector provided on the electric component or printed wiring board, as described in the U.S. Pat. No. 6,808,412, for example.

The male connector formed on the cable side is conventionally formed by thermally welding a reinforcing plate made of an electric insulating synthetic resin on one surface of the cable end portion using adhesives, as disclosed in the above patent document. The male connector is formed with an external electrode (pad) for signal line or the like on the other surface of the cable where the reinforcing plate is not mounted.

In electrically connecting the electric components or wiring boards for an electronic apparatus with the flexible cable, all the electric components or wiring boards are not arranged linearly. Accordingly, the flexible cable may be often bent or twisted in making the wiring.

By the way, the male connector formed on the cable side is simply connected by thermally welding the reinforcing plate made of the electric insulating synthetic resin onto the cable using the adhesives, as described above. Accordingly, even with the flexible cable, if a torque such as twist is applied to the flexible cable, there is risk that the cable is peeled from the reinforcing plate in some cases.

In the light of the above-mentioned problems, it is an object of the invention to provide an adaptor for a cable connector as a male connector that can be easily thermally welded with the cable to fix securely the cable, and can prevent the cable secured by adhesives from being peeled, and further can be easily mounted on a receptacle as a female connector.

SUMMARY OF THE INVENTION

In order to accomplish the above object, according to the invention, there is provided an adapter for a cable connector as a male connector secured with a cable end portion to form the electrical connection by being removably mounted on a receptacle as a female connector of the cable connector, comprising a pair of right and left operation portions, a pair of right and left guide pins integrally formed in front of the pair of operation portions and each having a pointed end portion at the front, a protection portion for connecting the pair of operation portions at the rear lower part thereof, a connection portion for connecting the pair of operation portions at the front upper part thereof, and a reinforcing portion like a thin plate for connecting the pair of guide pins, wherein the protection portion and the connection portion have an interval in the longitudinal direction and the vertical direction and are disposed in parallel to each other, and the under surfaces of the connection portion and the reinforcing portion are continuous flush to form a stationary surface for securing the cable end portion.

Also, it is preferable that the interval in the vertical direction between the protection portion and the connection portion for the adaptor is formed slightly larger than the thickness of the cable.

Moreover, in an adaptor for a cable connector according to the invention, it is preferable that a lock spring receiving portion for receiving a lock spring having a claw constituting a lock/unlock mechanism with the receptacle is formed inside the pair of right and left operation portions and the guide pins provided at the front thereof, a vertical slit is formed respectively above and below the lock spring receiving portion, and a horizontal slit for communicating the lock spring receiving portion to the outside, through which the claw of the lock spring moves in or out, is formed on the side of the guide pin.

In the adaptor according to the invention, the connection portion and the reinforcing portion to which the cable end portion is secured and the protection portion are formed in parallel to each other across the cable. It is prevented that the cable is peeled from the connection portion and the reinforcing portion as the stationary surface, whatever force is applied to the cable.

Also, since the interval in the vertical direction between the connection portion and the protection portion is slightly larger than the thickness of the cable, a force applied to the cable has no influence on the connection portion and the reinforcing portion as the cable stationary surface, whereby it is further prevented that the cable is peeled.

Moreover, since the lock spring receiving portion is formed inside the pair of right and left operation portions and the guide pins, and the lock spring having the claw constituting the lock/unlock mechanism between the adaptor and the receptacle can be received within the lock spring receiving portion, the adaptor can be easily mounted on or dismounted from the receptacle, and the electrical connection between the adaptor and the receptacle can be securely made.

Further features of the present invention will become apparent from the following description of exemplary embodiments (with reference to the attached drawings).

DESCRIPTION OF THE EMBODIMENTS

Referring to FIGS. 1 to 11, the preferred embodiments of an adaptor for a cable connector according to the present invention will be described below.

Figure 1:
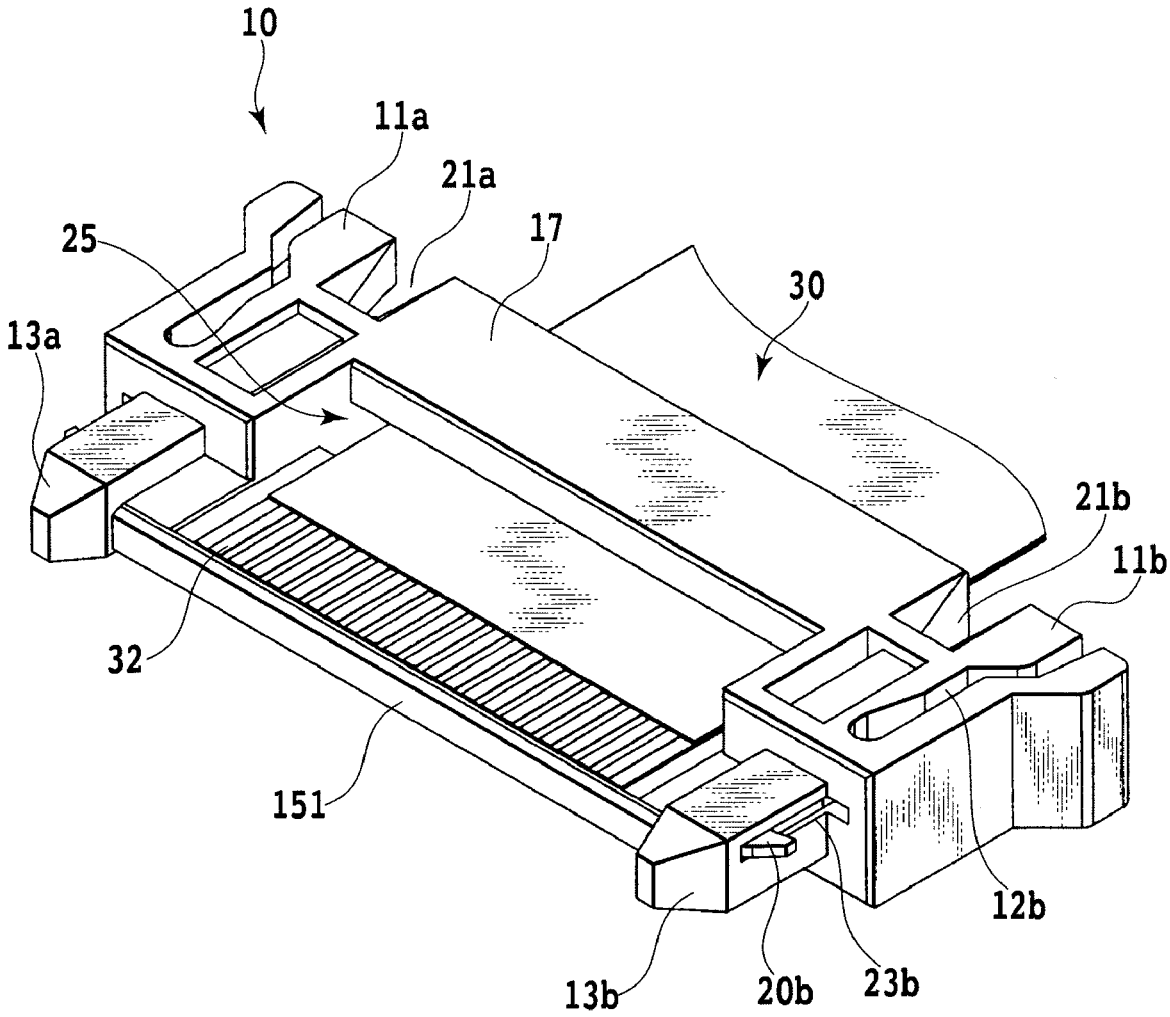
FIG. 1 is a perspective view of an adaptor for a cable connector according to the present invention, as seen from the lower, obliquely front side.
Figure 2:
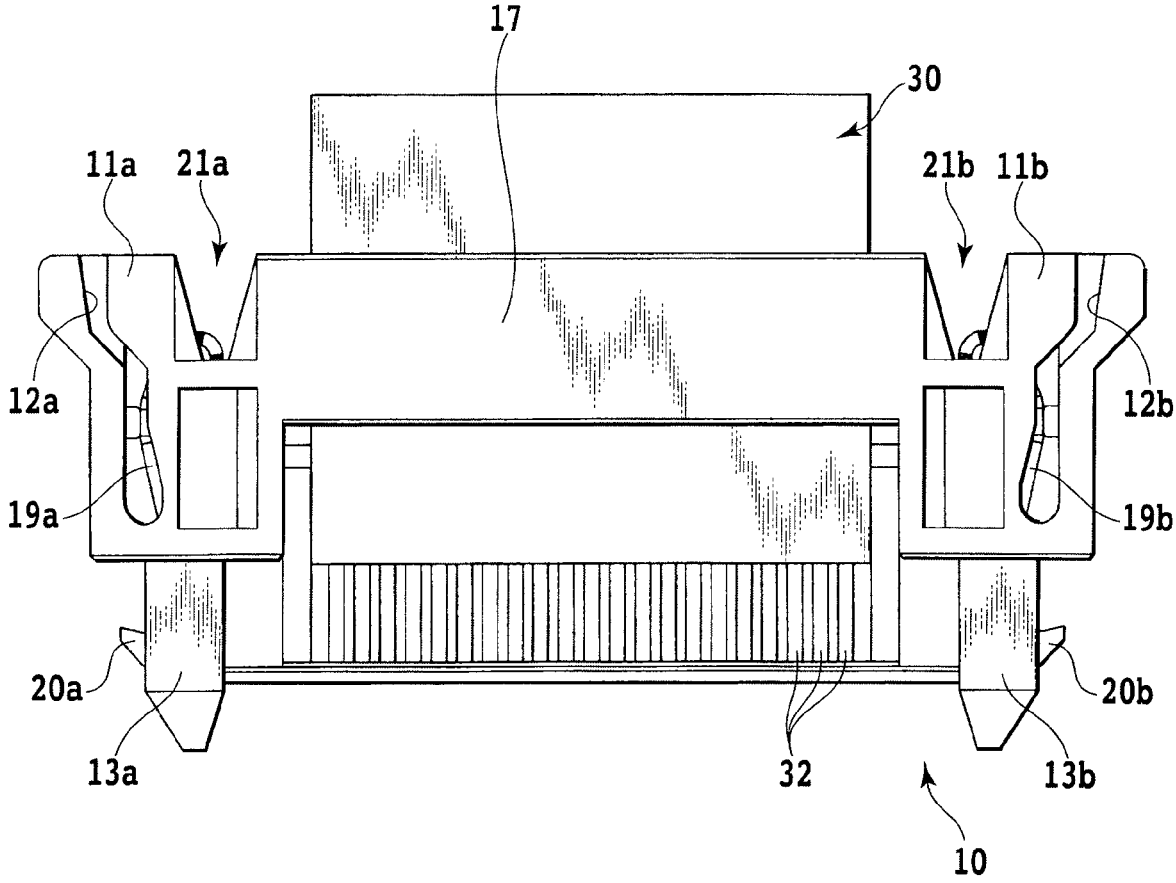
FIG. 2 is a lower view of the adaptor for the cable connector of FIG. 1.
Figure 3:
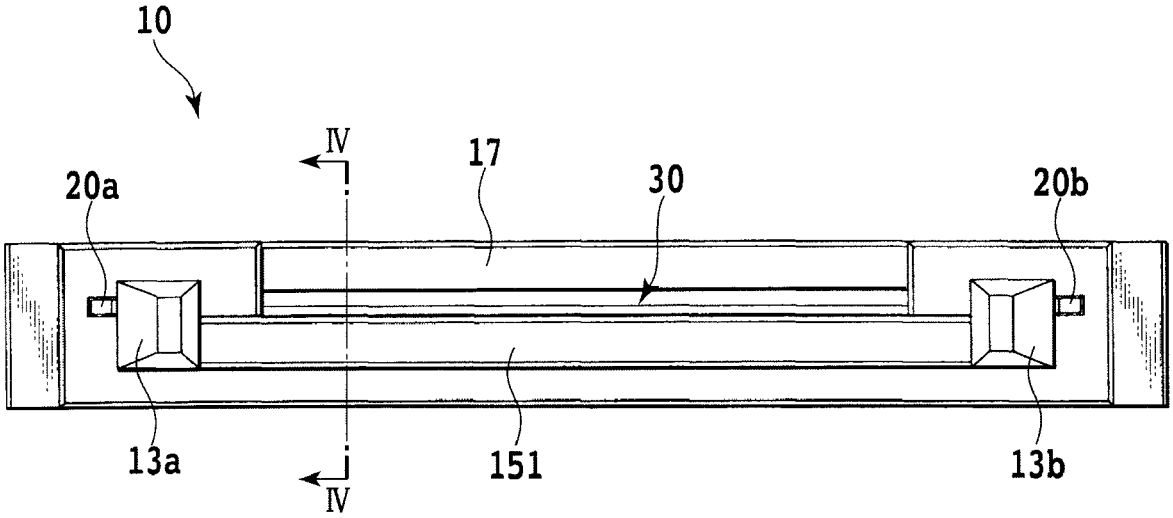
FIG. 3 is a front view of the adaptor for the cable connector of FIG. 1.
Figure 4:
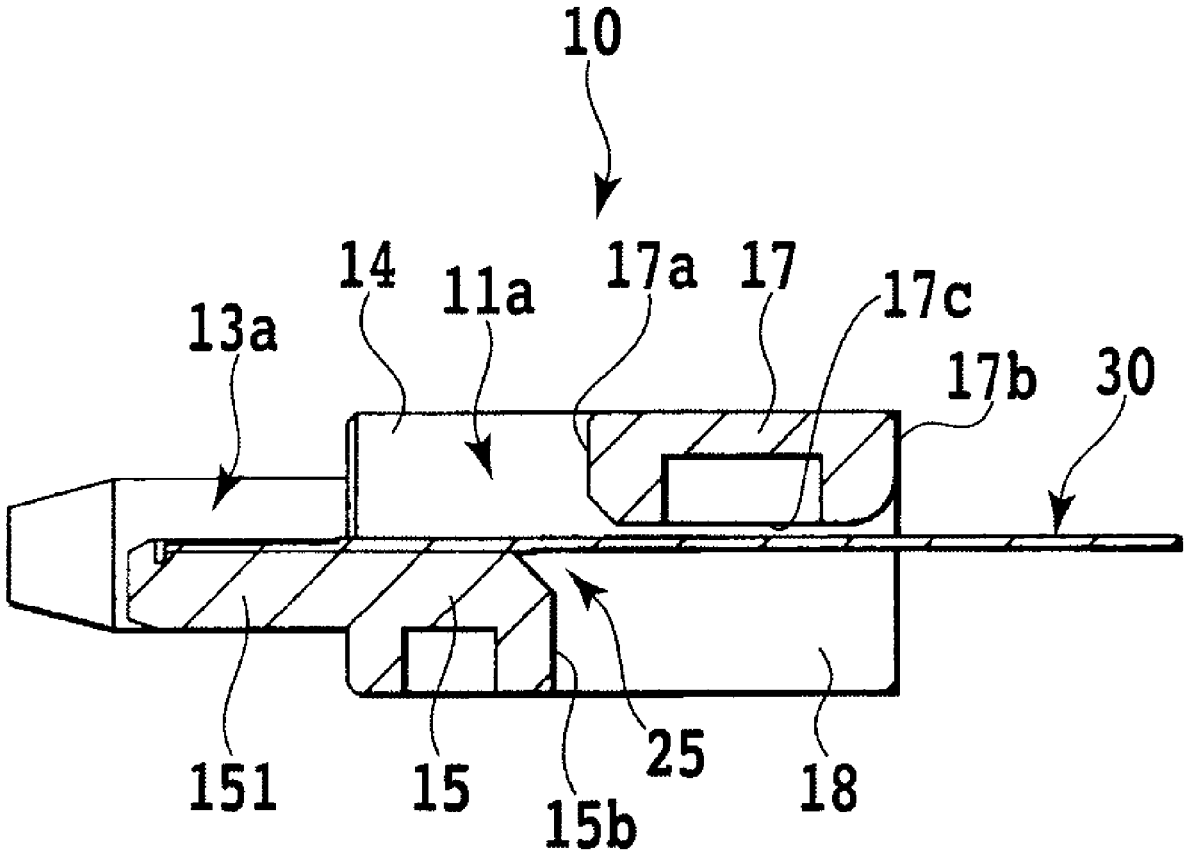
FIG. 4 is a cross-sectional view taken along the line IV-IV in FIG. 3.
Figure 5:
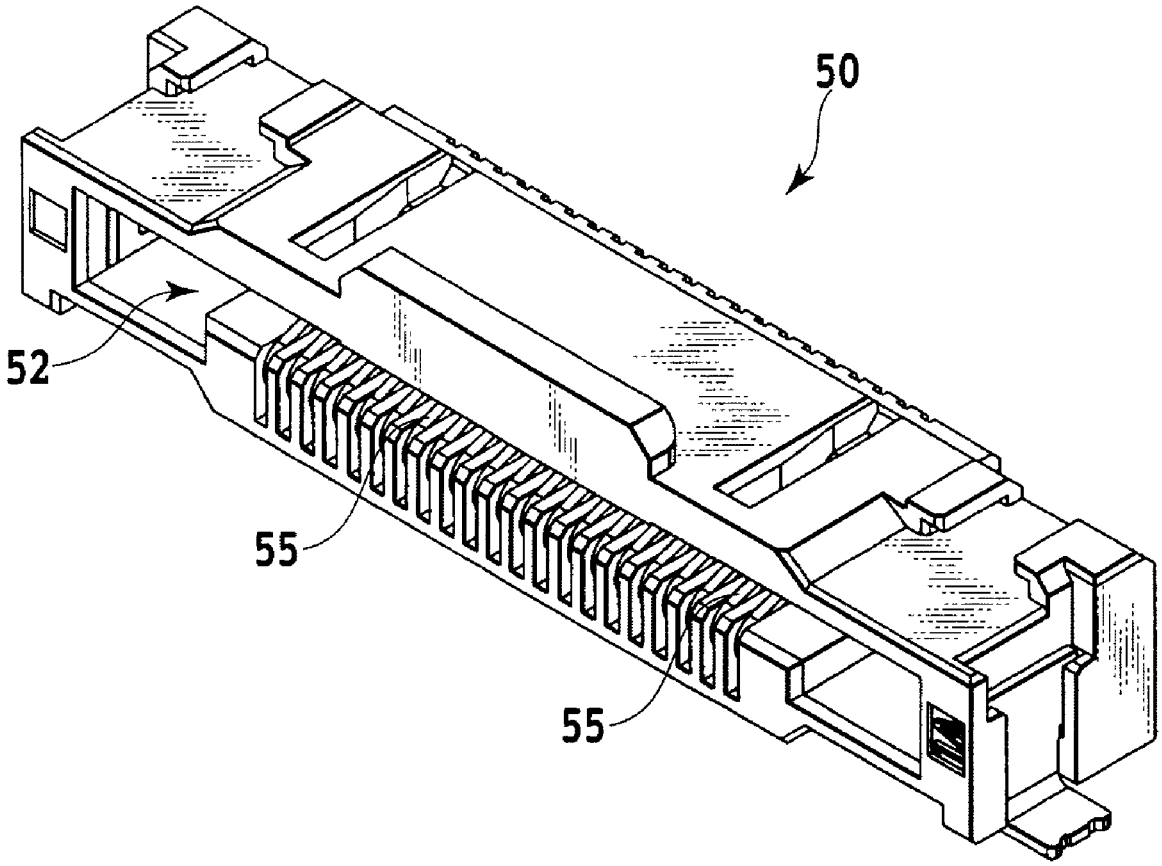
FIG. 5 is a perspective view of a receptacle as a female connector with which the adaptor for the cable connector of FIG. 1 is removably connected, as seen from the upper, obliquely front side.
Figure 6:
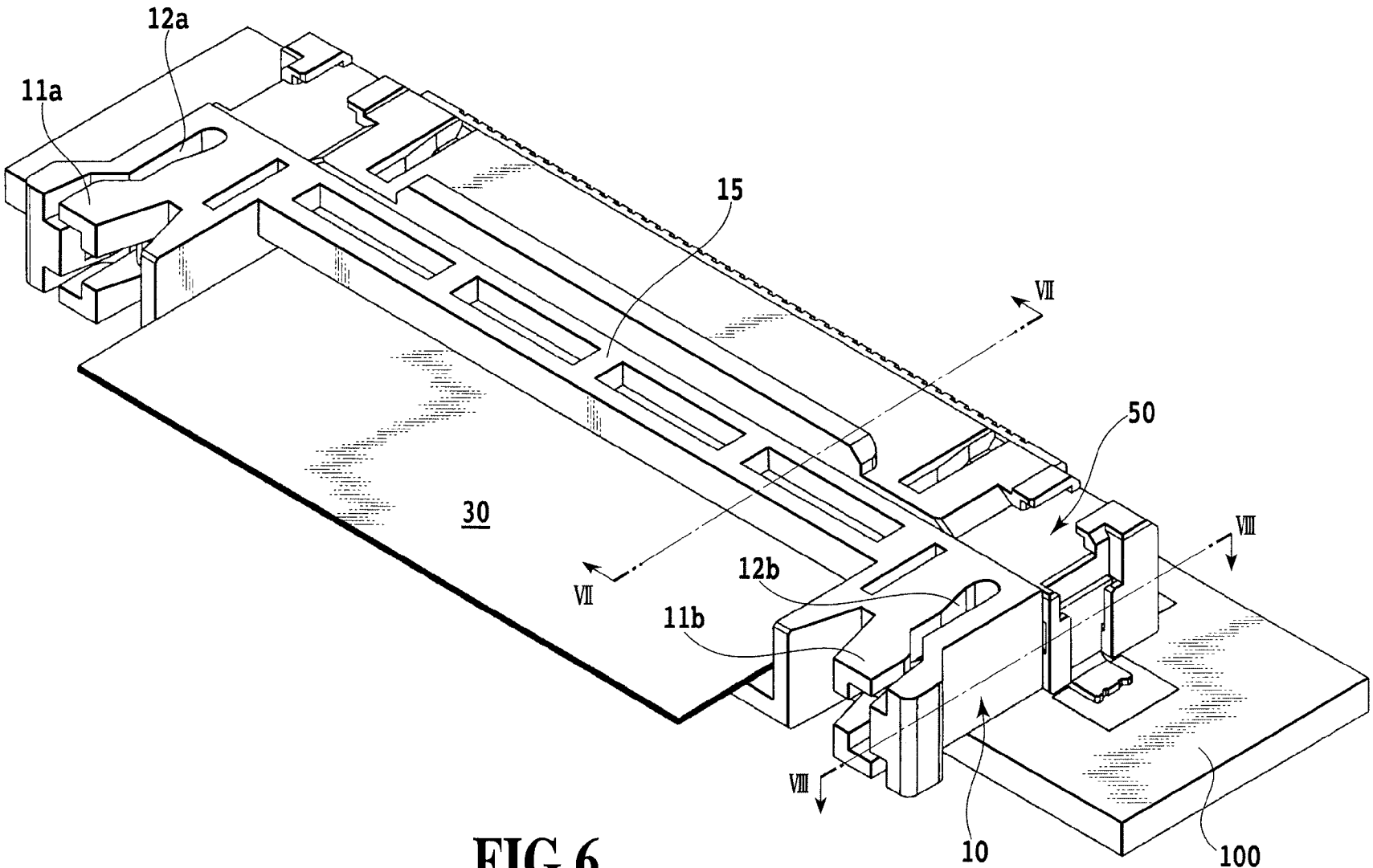
FIG. 6 is a perspective view showing a state where the adaptor for the cable connector of FIG. 1 is connected with the receptacle provided on a printed wiring board, as seen from the upper, obliquely front side.
Figure 7:
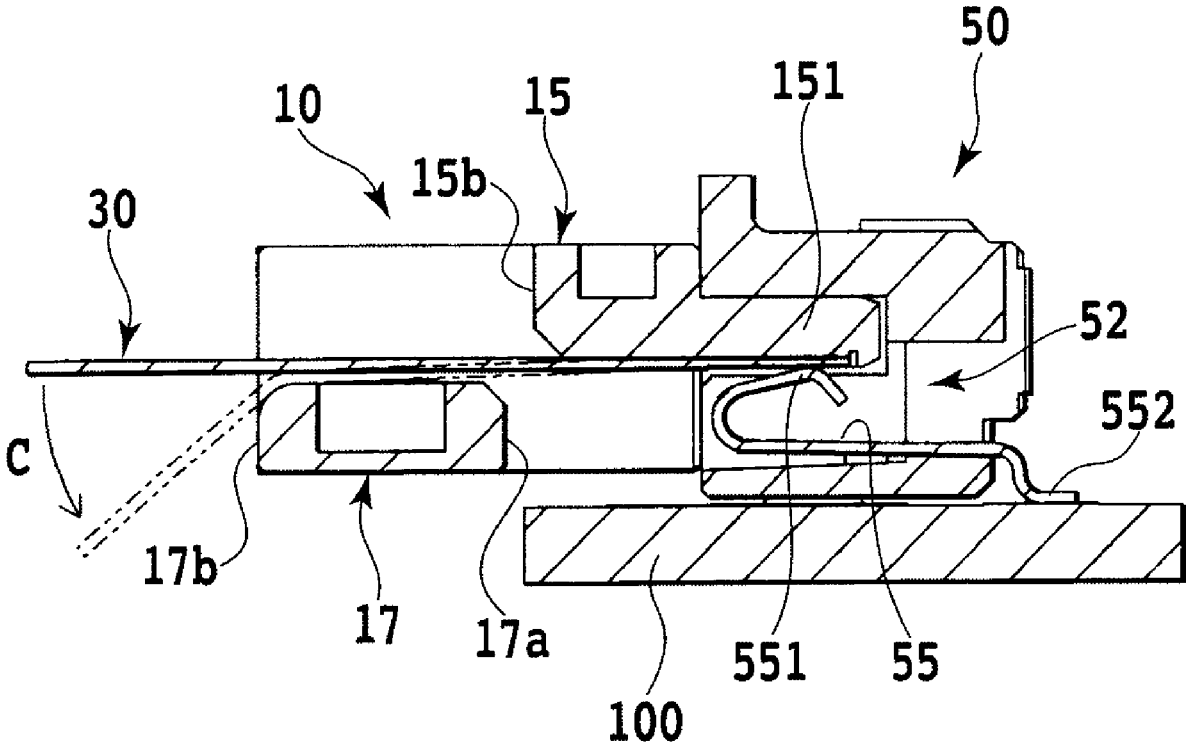
FIG. 7 is a cross-sectional view taken along the line VII-VII in FIG. 6.
Figure 8:
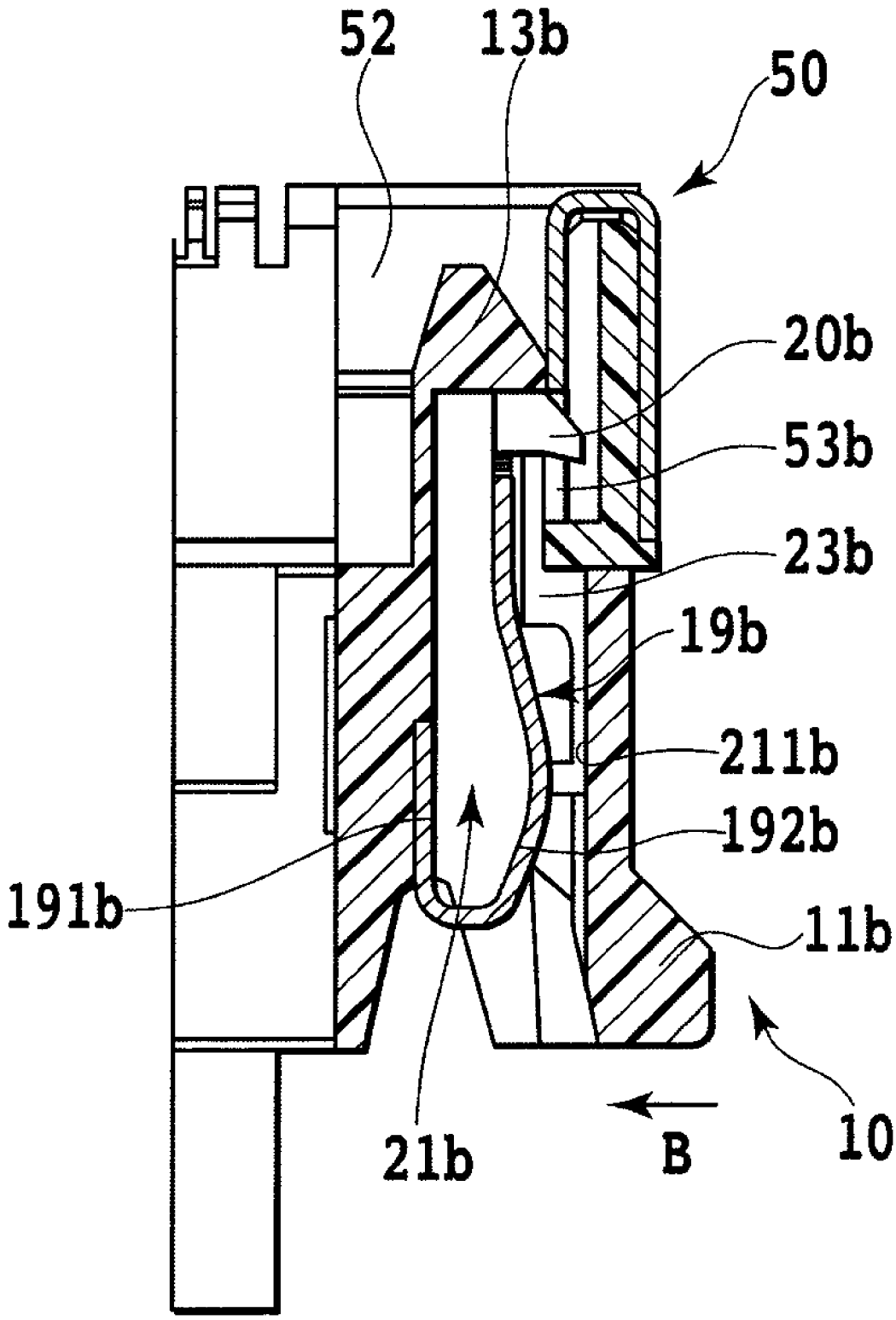
FIG. 8 is an essentially enlarged cross-sectional view, taken along the line VIII-VIII line in FIG. 6.
Figure 9:
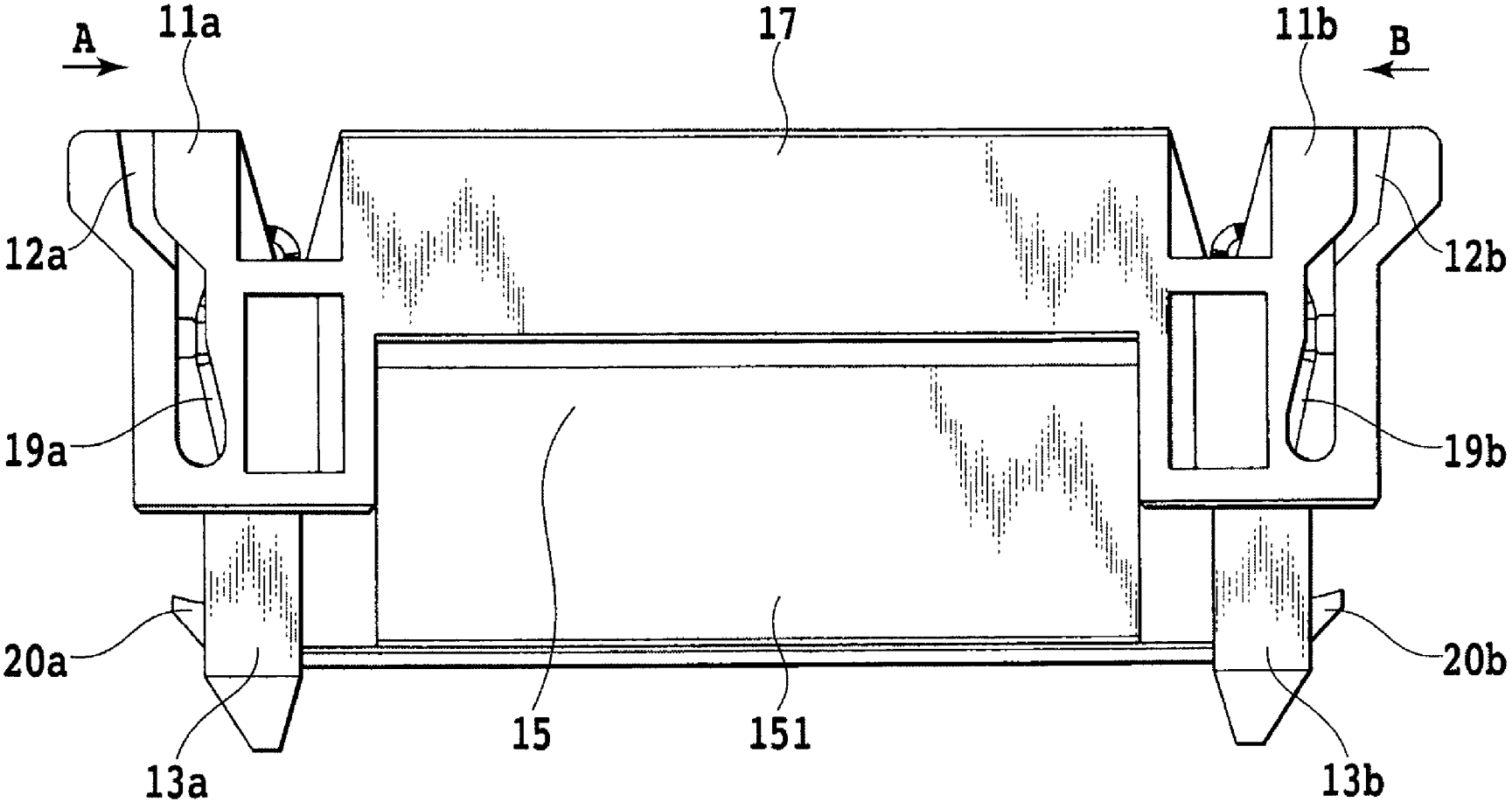
FIG. 9 is a lower view of the adaptor of simplex for the cable connector of FIG. 1 in a state where the cable is removed.
Figure 10:
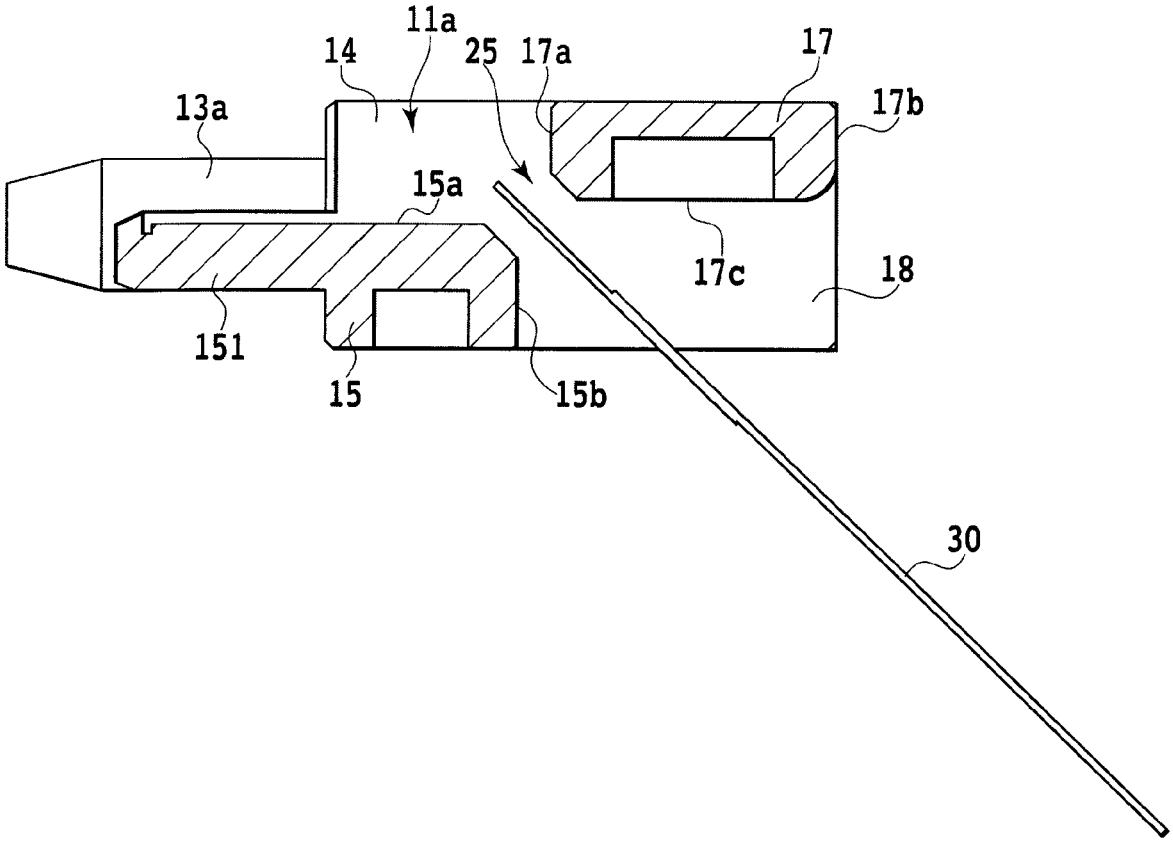
FIG. 10 is a cross-sectional view of the adaptor for the cable connector for explaining a way of mounting the cable on the adaptor for the cable connector, like FIG. 4 showing a state where the cable is inserted into the adaptor.
Figure 11:
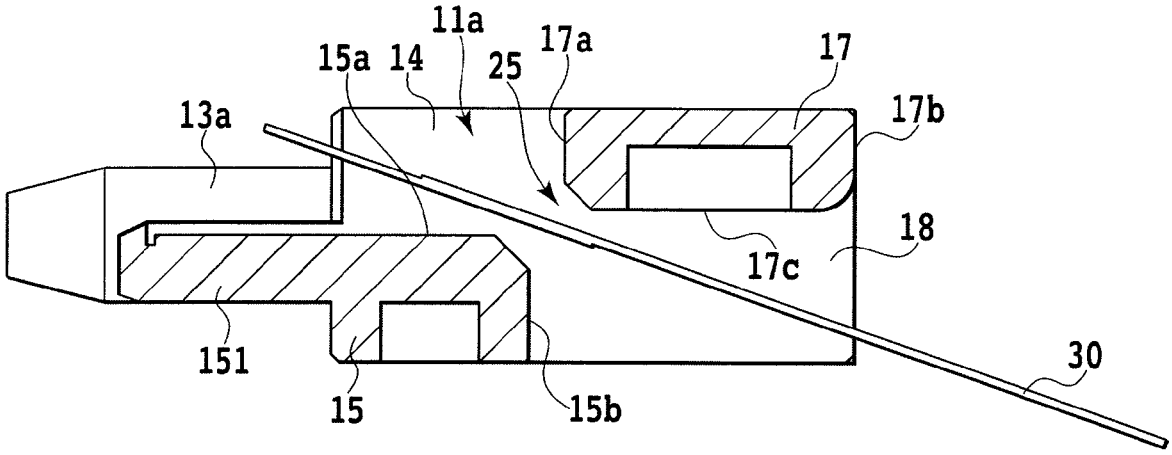
FIG. 11 is a cross-sectional view of the adaptor for the cable connector for explaining a way of mounting the cable on the adaptor for the cable connector, like FIG. 4 showing a state where the cable is furthermore inserted into the adaptor.

FIG. 1 is a perspective view of the adaptor for the cable connector according to the invention, as seen from the lower, obliquely front side. FIG. 2 is a lower view of the adaptor for the cable connector of FIG. 1. FIG. 3 is a front view of the adaptor for the cable connector of FIG. 1. FIG. 4 is a cross-sectional view taken along the line IV-IV in FIG. 3. FIG. 5 is a perspective view of a receptacle as a female connector with which the adaptor for the cable connector of FIG. 1 is removably connected, as seen from the upper, obliquely front side. FIG. 6 is a perspective view showing a state where the adaptor for the cable connector of FIG. 1 is connected with the receptacle provided on a printed circuit board, as seen from the upper, obliquely front side. FIG. 7 is a cross-sectional view taken along the line VII-VII in FIG. 6. FIG. 8 is an essentially enlarged cross-sectional view taken along the line VIII-VIII line in FIG. 6. FIG. 9 is a lower view of the adaptor of simplex for the cable connector of FIG. 1 in a state where the cable is removed. FIGS. 10 and 11 are cross-sectional views of the adaptor for the cable connector for explaining a way of mounting the cable on the adaptor for the cable connector, like FIG. 4 showing a state where the cable is inserted into the adaptor in the order of the drawing number.

The adapter for the cable connector (hereinafter simply referred to as an "adaptor") 10 according to the invention is formed as a male type connector portion of the cable connector, in which one end of the flexible printed wiring board 30 is secured to the adaptor 10, more particularly, to a connection portion 15 and a reinforcing portion 151 following it in this embodiment, as shown in FIGS. 1 to 4. The adaptor 10 is removably mounted on a receptacle 50 as a female type connector portion electrically connected to a printed circuit board 100 provided in an electronic apparatus (not shown) as a signal input/output part (see FIG. 7).

Herein, the flexible printed wiring board 30 for use in this embodiment has a constitution in which a plurality of conductive layers covered with a protective layer are formed on both sides of an insulating substrate, for example. The insulating substrate is molded of liquid crystal polyester (LCP), glass epoxy resin, polyimide (PI), polyethylene terephthalate (PET), or polyether-imide (PEI) having a thickness of about 50 μm, for example. The protective layer is formed of a thermosetting resist layer or polyimide film, for example.

The plurality of conductive layers are formed of copper alloy layers on one and/or the other surface of the insulating substrate, and have a plurality of signal line groups in parallel to each other at predetermined intervals in the width direction of the flexible printed wiring board 30, for example. Further, the ground lines are formed substantially in parallel adjacent to the signal line groups at one end of the flexible printed wiring board 30 in the width direction or between the signal line groups.

A contact pad 32 exposed out of a portion covered with the protective layer is formed at an end portion of each signal line or each ground line, respectively. In this embodiment, the contact pad 32 is formed on only one surface. The contact pad 32 is electrically connected to a corresponding contact 55 of the receptacle 50, as will be described later.

The adaptor 10 on which the flexible printed wiring board 30 is not mounted, typically comprises a pair of right and left operation portions 11*a* and 11*b*, a pair of right and left guide pins 13*a* and 13*b*, a connection portion 15, a protection portion 17 and a pair of lock springs 19*a* and 19*b*, as shown in FIG. 9. The adaptor 10 is preferably integrally molded of electrically insulating synthetic resin material, except for the pair of lock springs 19*a* and 19*b*.

The pair of right and left operation portions 11*a* and 11*b* are connected at the front upper part by the connection portion 15, and connected at the rear lower part by the protection portion 17. The connection portion 15 and the protection portion 17 are disposed in parallel, and disposed proximately in the longitudinal direction so that a back end face 15*b* of the connection portion 15 and a front end face 17*a* of the protection portion 17 may have an appropriate interval. Also, the connection portion 15 and the protection portion 17 are disposed proximately in the vertical direction so that a lower face 15*a* of the connection portion 15 and an upper face 17*c* of the protection portion 17 may has a slightly larger interval in the vertical direction than the thickness of the flexible printed wiring board 30. By configuring in this way, it can be understood that a space 14 and a space 18 are formed in front of the protection portion 17 under the connection portion 15 and behind the connection portion 15 above the protection portion 17, respectively, as shown in FIGS. 4, 10 and 11. Also, it can be understood that a gap 25 having longitudinal and vertical intervals formed between the connection portion 15 and the protection portion 17 communicates the space 14 and the space 18. The flexible printed wiring board 30 is passed through the gap 25 and then one end thereof is secured to the lower face 15*a* of the connection portion 15 and the lower face of the reinforcing portion 151 following it, as will be described later The lock spring receiving portions 21*a* and 21*b* (only 21*b* is shown in FIG. 8) for receiving the lock springs 19*a* and 19*b* are formed inside the pair of right and left operation portions 11*a* and 11*b*, as shown in FIG. 8. The lock spring receiving portions 21*a* and 21*b* extend up to the pair of right and left guide pins 13*a* and 13*b* described later. The vertical slits 12*a* and 12*b* are formed symmetrically above and below the lock spring receiving portions 21*a* and 21*b* in the pair of right and left operation portions 11*a* and 11*b*. By forming the vertical slits 12 and 12*b*, both end portions of the pair of operation portions 11*a* and 11*b* can be displaced resiliently toward the inside, as indicated by the arrows A and B in FIG. 9.

The pair of right and left guide pins 13*a* and 13*b* are integrally formed in front of the pair of right and left operation portions 11*a* and 11*b*. The pair of guide pins 13*a* and 13*b* are connected by a reinforcing portion 151 like a thin plate extending forward from the connection portion 15. The lower surface of the reinforcing portion 151 and the lower surface 15*a* of the connection portion 15 following behind are formed so as to be flush, and formed as a stationary surface on which one end portion of the flexible printed wiring board 30 is secured. That is, one end portion of the flexible printed wiring board 30 is secured on the lower surface of the reinforcing portion 151 and the lower surface 15*a* of the connection portion 15, as shown in FIGS. 1 to 4. Specifically, the lower surface of the reinforcing portion 151 and the lower surface 15*a* of the connection portion 15, and the surface of the flexible printed wiring board 30 where the contact pad 32 is not formed, are thermally welded with each other by using the adhesives. At this time, a plurality of contact pads 32 of the flexible printed wiring board 30 are all located on the rigid reinforcing plate 151. Accordingly, the contact pad 32 can make contact with the contact 55 provided on the receptacle 50 at a desired contact pressure, ensuring the electrical connection and maintaining the stable connection.

A front end face 17*a* of the protection portion 17 is located proximately to a rear end face 15*b* of the connection portion 15 following behind the reinforcing portion 151, as described above. Thereby, even if the flexible printed wiring board 30 is bent or twisted, a bending stress or twisting stress acts near the rear end face 17*b* of the protection portion 17 in the flexible wiring board 30, as indicated by the alternate long and short dashed lines in FIG. 7. The bending stress or twisting stress applied to the flexible printed wiring board 30 is less likely to act on the rear end face 15*b* of the connection portion 15 on which the flexible printed wiring board 30 is secured as the interval between the lower surface of the flexible printed wiring board 30 and the upper surface 17*c* of the protection portion 17 is smaller. That is, the protection portion 17 serves to suppress peeling from the lower surface of the reinforcing portion 151 and the lower surface 15*a* of the connection portion 15 on which one end portion of the flexible printed wiring board 30 is secured.

The pair of right and left guide pins 13*a* and 13*b* and the reinforcing portion 151 for connecting them are inserted into a cable receiving concave portion 52 of a receptacle 50 as a female connector as will be described later, together with one end portion of the flexible printed wiring board 30 secured to the reinforcing portion 151. Thereby, the plurality of contact pads 32 make contact with the plurality of contacts 55 disposed correspondingly within the cable receiving concave portion 52 to electrically connect the flexible printed wiring board 30 and the printed circuit board 100.

Since the pair of right and left guide pins 13*a* and 13*b* have the same structure mutually symmetrically, the guide pin 13*b* will be described here using FIG. 8, and the explanation of the guide pin 13*a* is omitted.

The guide pin 13*b* having a pointed end portion at the front is internally formed with the lock spring receiving portion 21*b* for receiving the lock spring 19*b*, as described above. On the side face of the guide pin 13*b*, a horizontal slit 23*b* through which a claw 20*b* of the lock spring 19*b* is moved in or out is formed from the lock spring receiving portion 21*b* toward the outside. The lock spring receiving portion 21*b* communicates with the outside through a rear opening into which the lock spring 19*b* is inserted and the vertical slit 12*b* and the horizontal slit 23*b*.

An internal circumferential face of the lock spring receiving portion 21*b* which is positioned outside the vertical slit 12*b* of the operation portion 11*b* is formed as a pressing portion 211*b* making contact with a curvature portion 192*b* of the mounted lock spring 19*b*. The pressing portion 211*b* is moved against an elasticity of the curvature portion 192*b* of the lock spring 19*b* when the end portion of the operation portion 11*b* is operationally pushed in a direction as indicated by the arrow B in FIG. 8. Thereby, the curvature portion 192*b* of the lock spring 19*b* and the claw 20*b* are moved in the direction as indicated by the arrow B. On the other hand, if a pushing operation at the outer end portion of the operation portion 11*b* is released, the pressing portion 211*b* is restored to an initial state due to a restoring force of the curvature portion 192*b* of the lock spring 19*b*.

The top of the claw 20*b* of the lock spring 19*b* projects through the horizontal slit 23*b* toward outside (see FIG. 1). The lock spring 19*b* comprises a securing portion 191*b* that is secured in the lock spring receiving portion 21*b*, the claw 20*b* for selectively engaging the peripheral edge of a through hole 53*b* formed on the inner periphery of the adaptor receiving concave portion 52 of the receptacle 50, and the curvature portion 192*b* with elasticity which connects the securing portion 191*b* and the claw 20*b*. The claw 20*b* of the lock spring 19*b* takes an engaged state where it projects via the slit 23*b* to be engaged in the peripheral edge of the through hole 53*b* or an unengaged state where it is pulled into the lock spring receiving portion 21*b*, along with the movement of the curvature portion 192*b*.

The receptacle 50 as the female connector has a fitting portion and a lock/unlock mechanism, as shown in FIG. 5. The fitting portion is formed in the central part of the receptacle 50, and is the portion into which the reinforcing portion 151 of the adaptor 10 and one end portion of the flexible printed wiring board 30 are fitted with a predetermined gap. The lock/unlock mechanism selectively places the one end portion of the flexible printed wiring board 30 in a lock state or unlock state in cooperation with the operation portions 11*a* and 11*b* and the lock springs 19*a* and 19*b*.

Specifically, the fitting portion has the adaptor receiving concave portion 52 for receiving the reinforcing portion 151 of the adaptor 10 and the one end portion of the flexible printed wiring board 30.

The plurality of contacts 55 making contact with the plurality of contact pads 32 provided at one end portion of the flexible printed wiring board 30 to make the electrical connection are provided below the adaptor receiving concave portion 52. The plurality of contacts 55 are arranged in parallel to each other, a contact point portion 551 of each contact 55 has elasticity and projects into the adaptor receiving concave portion 52. A stationary terminal portion 552 of each contact 55 passes through a back wall of the receptacle 50 and projects outside, as shown in FIG. 7. The stationary terminal portion 552 of each contact 55 is fixed by soldering to the corresponding outer contact point of the printed circuit board 100.

Thereby, the contact pad 32 of the flexible printed wiring board 30 fitted into the adaptor receiving concave portion 52 of the receptacle 50 is consequently held between the reinforcing plate 151 of the adaptor 10 and the contact point portion 551 of the contact 55 to be electrically connected to the contact point portion 551.

It is preferred that the positioning portions for positioning the top end of the guide pins 13*a* and 13*b* are respectively formed on both sides of the adaptor receiving concave portion 52 in the fitting portion corresponding to the guide pins 13*a* and 13*b* of the adaptor 10.

The lock/unlock mechanism is formed of the through hole 53*b* formed near each positioning portion of the adaptor receiving concave portion 52 and each claw 20*a*, 20*b* of the lock spring 19*a*, 19*b*, as shown in FIG. 8.

In such a constitution, when the adaptor 10 with one end portion of the flexible printed wiring board 30 being connected is connected to the receptacle 50, the guide pins 13*a* and 13*b* of the adaptor 10 are initially positioned and introduced by the positioning portions of the receptacle 50. Subsequently, one end portion of the flexible printed wiring board 30 is inserted between the contact point portion 551 of the contact 55 and the upper wall making up the receptacle 50. At this time, the claws 20*a* and 20*b* of the lock springs 19*a* and 19*b* are once urged into the lock spring receiving portions 21*a* and 21*b* and then project toward the through holes 53*a* and 53*b*, so that the claws 20*a* and 20*b* engage the peripheral edge of the through holes 53*a* and 53*b*. Thereby, the adaptor 10 is held in a lock state for the receptacle 50. On the other hand, when the adaptor 10 is removed from the receptacle 50, both ends of the operation portions 11*a* and 11*b* are pressed in the direction approaching each other, and the claws 20*a* and 20*b* are placed in an unengaged state with the peripheral edge of the through holes 53*a* and 53*b*, after which the adaptor 10 is pulled away. Thereby, the adaptor 10 is dismounted from the receptacle 50.

Finally, a method for securing the flexible printed wiring board 30 on the adaptor 10 will be described below. Specifically, a method for fixing the flexible printed wiring board on the lower surface of the reinforcing portion 151 and the lower face 15*a* of the connection portion 15 by thermal welding will be simply described below with reference to FIGS. 10 and 11. First of all, the adaptor 10 is disposed upside down, as shown in FIGS. 10 and 11. The adhesive is applied to the surface of one end portion of the flexible printed wiring board 30 on which no contact pads 32 are formed, and the flexible printed wiring board 30 is set such that the surface on which the contact pads 32 are formed is upward. Then, the flexible printed wiring board 30 is inserted, with the one end portion where the contact pad 32 is formed being the front, into the space 18 located under the protection portion 17 through the gap 25 toward the space 14 located above the connection portion 15, as shown step by step in FIGS. 10 and 11. Since the flexible printed wiring board 30 is only passed through the gap 25 of a short length, it can be easily inserted without the surface on which the adhesive is coated adhering halfway to the connection portion 15. Subsequently, the surface on which the adhesive is coated is put from upward at a predetermined position on the lower surface of the reinforcing portion 151 and the lower face 15*a* of the connection portion 15, and the flexible printed wiring board 30 is heated from above via the space 14 by a heating suppression member (not shown), for example, and pressed thereon. Thereby, the flexible printed wiring board 30 can be thermally welded simply and firmly at the predetermined position on the lower surface of the reinforcing portion 151 and the lower face 15*a* of the connection portion 15, as shown in FIG. 4.

Accordingly, one end portion of the flexible printed wiring board 30 is secured to the adaptor 10 by a simple bonding operation. Also, behind the lower face 15*a* of the connection portion 15 and the lower surface of the reinforcing portion 151, the protection portion 17 is located with a slight clearance 25 in the longitudinal direction from the connection portion 15 across the flexible printed wiring board 30 secured to the lower face 15*a* of the connection portion 15 and the lower surface of the reinforcing portion 151. Even if the flexible printed wiring board 30 is bent or twisted in the direction of the arrow C, there is no force of directly peeling the flexible printed wiring board 30 from the lower face 15*a* of the connection potion 15, because the protection plate 17 is interposed, as shown in FIG. 7. That is, there is no risk that the flexible printed wiring board 30 is peeled from the connection portion 15 and the reinforcing portion 151.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An adapter for a cable connector secured with a cable end portion to make an electrical connection by being removably mounted to said cable connector by insertion into female connector of the cable connector, comprising:

a pair of right and left operation portions each having a rear lower part and a front upper part thereof separated from each other in both longitudinal, rear to front, and vertical, lower to upper, directions;

a pair of right and left guide pins integrally formed in front of said pair of operation portions and each having a pointed end portion at the front;

a protection portion for connecting said pair of operation portions at the rear lower part thereof;

a connection portion for connecting said pair of operation portions at the front upper part thereof, said connection portion having a lower surface:

wherein said protection portion and said connection portion have an interval in the longitudinal direction and the vertical direction and are disposed in parallel to each other;

a reinforcing portion adjacent said connection portion and having a lower surface; and the lower surfaces of said connection portion and of said reinforcing portion are continuous flush to form a stationary surface for securing said cable end portion.

2. An adaptor for a cable connector as claimed in claim 1, wherein the interval in the vertical direction between said protection portion and said connection portion is formed slightly larger than the thickness of said cable.

3. An adaptor for a cable connector as claimed in claim 2, wherein a space is formed above said protection portion and behind said connection portion, and a space is formed under said connection portion and before said protection portion, and said interval between said protection portion and said connection portion is formed to connect the space above said protection portion and the space under said connection portion.

4. An adaptor for a cable connector as claimed in claim 1, wherein a lock spring receiving portion for receiving a lock spring having a claw constituting a lock/unlock mechanism with said female connector is formed inside said pair of right and left operation portions and the guide pins provided at the front thereof, a vertical slit is formed above and below said lock spring receiving portion, and a horizontal slit for communicating the lock spring receiving portion to the outside, through which the claw of said lock spring moves in or out, is formed on the side face of said guide pins.

* * * * *